US012428772B2

(12) United States Patent
Cavarretta et al.

(10) Patent No.: US 12,428,772 B2
(45) Date of Patent: Sep. 30, 2025

(54) LAUNDRY DRYER

(71) Applicant: Electrolux Appliances Aktiebolag, Stockholm (SE)

(72) Inventors: Francesco Cavarretta, Porcia (IT); Rudy Dal Molin, Porcia (IT); Davide Camata, Porcia (IT); Francesco Lucchini, Porcia (IT); Sergio Pillot, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 1079 days.

(21) Appl. No.: 17/415,370

(22) PCT Filed: Dec. 21, 2018

(86) PCT No.: PCT/EP2018/086788
§ 371 (c)(1),
(2) Date: Jun. 17, 2021

(87) PCT Pub. No.: WO2020/126056
PCT Pub. Date: Jun. 25, 2020

(65) Prior Publication Data
US 2022/0056630 A1 Feb. 24, 2022

(51) Int. Cl.
*D06F 58/20* (2006.01)
*D06F 58/06* (2006.01)

(52) U.S. Cl.
CPC ..... *D06F 58/206* (2013.01); *D06F 58/06* (2013.01)

(58) Field of Classification Search
CPC ..... D06F 58/206; D06F 58/06; D06F 58/20
See application file for complete search history.

(56) References Cited

U.S. PATENT DOCUMENTS 10,196,773 B2 2/2019 Bison et al.
2010/0011615 A1* 1/2010 Steiner ..... D06F 58/206 34/493

FOREIGN PATENT DOCUMENTS

CN 104471142 A 3/2015
CN 105324529 A 2/2016
(Continued)

OTHER PUBLICATIONS

International Search Report and Written Opinion for International Application No. PCT/EP2018/086787, dated Apr. 1, 2019, 14 pages.
(Continued)

*Primary Examiner* — Michael G Hoang
*Assistant Examiner* — Bao D Nguyen
(74) *Attorney, Agent, or Firm* — Bradley Arant Boult Cummings LLP

(57) ABSTRACT

A laundry dryer including: a drum, a motor to rotate the drum, a casing supporting the drum and including a rear wall and a front wall, a basement having first, second, third and fourth quarters with the first and third quarters on one side of a plane perpendicular to the basement plane and parallel to the drum axis, and the second and fourth quarters on an opposite side of the plane, a process air conduit in fluid communication with the drum and including a basement process air conduit located in the basement, and a heat pump circuit including a compressor, and first and second heat exchangers. The first and second heat exchangers are in the basement process air conduit mainly within third and fourth quarters, and the motor and compressor are mainly in, respectively, in the first and second quarters.

18 Claims, 6 Drawing Sheets

(56) References Cited

FOREIGN PATENT DOCUMENTS

| | | | | |
|---|---|---|---|---|
| CN | 105518208 | A | 4/2016 | |
| CN | 106661815 | A | 5/2017 | |
| EP | 2549008 | A1 * | 1/2013 | ..... D06F 58/206 |
| EP | 2990523 | A1 | 3/2016 | |
| EP | 2990524 | A1 | 3/2016 | |
| EP | 3040470 | A1 | 7/2016 | |
| EP | 3124684 | A1 * | 2/2017 | ..... D06F 58/20 |
| WO | WO-2012120827 | A1 * | 9/2012 | ..... D06F 58/206 |

OTHER PUBLICATIONS

International Search Report and Written Opinion for International Application No. PCT/EP2018/086788, dated Apr. 8, 2019, 15 pages.
English Translation of the Chinese Office Action with Search Report for Chinese Application No. 201880100312.6, dated Oct. 25, 2022, 12 pages.

* cited by examiner

M
18w2
R=P1 = H1 = F=A = EX
12
13
50
(X,Y)
21

18w1
33
51
29
Q1
Q2
P2 = H2
24a
36
25
Q3
Q4
tc
31
28
18
35
32
te
Whe
W
36
20

LAUNDRY DRYER

This application is a U.S. National Phase application of PCT International Application No. PCT/EP2018/086788, filed Dec. 21, 2018, which is incorporated by reference herein.

TECHNICAL FIELD

The present invention relates to a laundry dryer including a heat pump system having an improved process air duct within the basement of the laundry dryer.

BACKGROUND OF THE INVENTION

The heat pump technology in a laundry dryer is at present the most efficient way to dry clothes in terms of energy consumption. In a heat pump system of the laundry dryer an air stream flows in a closed air stream circuit. Further, the heat pump system includes a closed refrigerant circuit, a condenser and an evaporator. The air stream is moved by a fan, passes through a laundry chamber, which is preferably formed as a rotatable laundry drum, and removes there water from wet clothes. Then, the air stream is cooled down and dehumidified in the evaporator, heated up in the condenser and re-inserted into the laundry drum again.

The refrigerant is compressed by a compressor, condensed in the condenser, expanded in an expansion device and then vaporized in the evaporator.

Thus, the condenser and the evaporator are components of the air stream circuit as well as of the refrigerant circuit. The condenser and the evaporator are heat exchangers between the air stream circuit and the refrigerant circuit.

Usually, the components of the heat pump system (described above) are placed in a basement of the laundry dryer. The basement of a laundry dryer is part of a casing, which includes—in addition to the basement—also walls, substantially vertically supported from the basement, such as a front wall and a rear wall, and lateral walls. In the casing, the laundry drum is rotatably supported. In particular, the compressor, the evaporator and the condenser are arranged in said basement below the laundry drum. An air duct of the air stream circuit has to pass the basement of the dryer, bringing the humid air to the evaporator and reintroducing the dry air from the condenser in the drum.

The basement therefore includes an inlet and an outlet for the air: from the inlet, the humid air is arriving from the drum entering the basement duct, and from the outlet the dry hot air leaves the basement, for example re-entering the drum. A fan is generally positioned in proximity of such an outlet in order to blow the process air dried by the heat pump back to the drum.

The various components of the heat pump, with particular reference to the heat exchangers and the compressor, as well as the motor of the dryer and/or of the laundry drum, are rather "bulky" and the positioning of the same in the confined volume present in the basement of the dryer is not always simple. However, their positioning affects the flow of process air in the basement itself because the process air needs to flow from the inlet to the outlet to the basement and at the same time to exchange heat in the heat pump.

The efficiency of the air flow within the basement is important for the overall efficiency of the dryer. From a fluid dynamic point of view, the flow of air is preferably "as straight as possible" to minimize vortexes and turbulences in the same. Therefore, the presence of curves in the basement air conduit is hindering the efficiency of the dryer. However, most of prior art dryers include bends or curves in the basement duct for the process air.

EP 2549008 of the same Applicant relates to a laundry treatment apparatus, in particular to a dryer or washing machine having drying function, comprising: a laundry storing chamber for treating laundry using process air, a process air loop for circulating the process air through the laundry storing chamber, a motor for driving the rotatably supported laundry storing chamber and/or for driving a process air blower arranged in the process air loop, and a heat pump system for dehumidifying and heating the process air, the heat pump system having a refrigerant loop comprising: a first heat exchanger for heating a refrigerant and cooling the process air, a second heat exchanger for cooling the refrigerant and heating the process air, a refrigerant expansion device arranged in the refrigerant loop, and a compressor arranged in the refrigerant loop, wherein the first and second heat exchangers are arranged in a process air duct section of the process air loop which is located in a base section of the apparatus. According to the invention the process air duct section is arranged in a middle region of the base section, a first region of the base area of the base section is at a first side of or with respect to the process air duct section, and a second region of the base area of the base section is at a second side of or with respect to the process air duct section, such that the process air duct section is between the first and second region.

SUMMARY OF THE INVENTION

It is an object of the present invention to provide a laundry dryer with a heat pump system, wherein the flow of the process air is improved, with particular reference to the process air flow within the basement of the laundry dryer. Further, it is an object of the present invention to provide a laundry dryer with a heat pump system, wherein the overall efficiency is improved.

According to an aspect, the invention relates to a laundry dryer including:

- a drum to contain laundry to be dried, said drum being rotatable about a drum axis;
- a motor apt to rotate the drum about the drum axis;
- a casing rotatably supporting the drum and including:
  - a rear wall and a front wall;
  - a basement defining a basement plane (X,Y) and in which a first, a second, a third and a fourth quarters are identifiable by means of two intersecting first and second planes, the first plane being perpendicular to said basement plane (X,Y) and passing through said drum axis and the second plane being perpendicular to said first plane and passing through a center line of the basement substantially parallel to said rear wall of the casing, the first and third quarters being defined on one side of the first plane and the second and fourth quarters being defined on an opposite side of the first plane;
- a process air conduit in fluid communication with the drum where process air is apt to flow, said process air conduit including a basement process air conduit located in the basement;
- a heat pump having a heat pump circuit in which a refrigerant can flow, said heat pump circuit including a compressor, a first heat exchanger where the refrigerant is cooled off and the process air is heated up, and a second heat exchanger where the refrigerant is heated up and the process air is cooled off; said first heat exchanger and said second heat exchanger being arranged in the basement process air conduit within said third and fourth quarters of said basement for the majority of their volume in order to perform heat exchange between said refrigerant flowing in said heat pump circuit and said process air; and said motor and said compressor being located, respectively, in said first and second quarter of said basement for the majority of their volume.

In the following, with the term "dryer" machines capable of performing drying cycles are meant.

The dryer of the invention includes a drying chamber, such as a drum, in which the load, e.g. clothes or laundry, to be dried is placed. The drum is part of an air process circuit, which includes an air conduit for channeling a stream of air to dry the load. The process air circuit is connected with its two opposite ends to the drum. More specifically, hot dry air is fed into the drum, flowing over the laundry, and the resulting humid (and cooler) air exits the same.

The laundry dryer includes a heat pump system. The humid air stream rich in water vapor and exiting the drum is fed to an evaporator (or second heat exchanger) of the heat pump, where the moist warm process air is cooled and the humidity present therein condenses. The resulting cool dry air is then heated up before entering again in the drying chamber by means a condenser (or first heat exchanger) of the heat pump, and the whole loop is repeated till the end of the drying cycle.

Each heat exchanger defines a width, a height and a length. The length in the following is defined as the "thickness" of the heat exchanger, also defined as the space-interval flown by the process air in order to cross the heat exchanger. The width and height of the heat exchanger form a "heat exchanger surface" which is hit by the process air. Commonly, heat exchangers are formed by tubes: each tube forms a meandering shape so that different layers one on top of or above the others are created. Process air travels through the portions of the same tube, which are substantially vertically stacked, at the same time, i.e. in parallel. Several tubes may be used, each extra tube increasing for example the thickness of the heat exchanger: the tubes are positioned one adjacent to the other along its thickness, so that the process air travels through the adjacent tubes one after the other, i.e. in series. Connecting ducts or pipes fluidly connect the different tubes. These connecting ducts are positioned at the sides of the heat exchanger "increasing" their width. However, in the following as "width" of the heat exchanger, only the width of the heat-exchanging surface is taken into account, and the lateral extension caused by the connecting ducts is not considered.

The dryer furthermore includes a casing or bearing structure, comprising preferably a basement, a front wall and a rear wall. Preferably, front wall and rear wall are mounted on the basement. The front wall is advantageously provided with a through opening, at which a loading/unloading door is mounted to access the drum in order to locate or remove the laundry. Preferably, a part of the rear end of the drum abuts against the rear wall of the cabinet and even more preferably a gasket is interposed therebetween; as well as a part of the front end of the drum abuts against the front wall with also preferably a gasket therebetween. Preferably, the casing includes also further walls, e.g. lateral walls and a top wall.

Within the casing, the drum is rotatably mounted for rotating according to a horizontal, or at least substantially horizontal, or tilted rotational axis. Support element(s) for rotatably supporting the drum are provided for within the casing. The drum is rotated preferably by means of a motor which defines a motor axis, for example which corresponds to the axis of a motor shaft.

The basement of the dryer of the invention includes a portion of the process air conduit, called basement process air conduit, which includes substantially a duct formed in the basement (basement air duct). The basement air duct includes an inlet and an outlet which also corresponds to the process air inlet and outlet of the basement, that is, they correspond to the inlet and outlet of process air in and out the basement. In a possible embodiment, the inlet of the duct is located at the front wall of the casing, for example at a rim of the opening closed by the loading/unloading door. In this case, the outlet is positioned at the rear wall. However, in a different embodiment, the inlet of the duct is at the rear wall of the cabinet, and the outlet is positioned at the front wall.

Within said basement air conduit, and preferably in the basement air duct, both heat exchangers of the heat pump system are located. As for the heat exchangers, also a duct width and duct height are defined. The duct width and height define in turn the available cross section of the duct for the process air to flow and, where the heat exchangers are located, also to perform a heat exchange. Therefore, where the heat exchangers are located in the duct, the width of the duct is substantially equal to the width of the heat exchangers (i.e. the space in which the "lateral bends" of the ducts/pipes are present is not considered in the width calculation). The height of the duct is its dimension along the vertical direction. Height and width may vary along the basement conduit extension in the basement. Furthermore, the basement air conduit channels the process air entering the basement to the evaporator of the heat pump and then channels the process air exiting the condenser to the outlet of the basement. From the outlet of the basement, the process air—dried by the condenser—is fed, for example via an additional portion of the process air conduit realized preferably in the rear wall of the cabinet, to the drum so as to dry the laundry therein.

The basement air duct includes one or more lateral walls depending on its geometry. If the geometry of the duct is substantially cylindrical or of a cylindroid form, the duct portion includes a single lateral wall having substantially circular cross section, which may change in diameter depending on the position in which the cross section is measured. Alternatively, two opposite lateral walls can be present, for example one substantially parallel to the other and defining substantially parallel planes. Alternatively, the lateral walls have a curved shape.

Further, still in the basement, the dryer includes a compressor of the heat pump. The compressor is positioned outside the process air basement duct and it is a relatively "bulky" element.

Outside the basement duct and still within the basement, the motor of the drum is also located. Further, the motor of the duct can be also the motor of a fan positioned in the process air conduit to force the flow of process air in the same. Alternatively, a second motor to drive the fan is positioned in the basement. Generally, the fan motor is smaller than the drum motor.

In a standard operative position, the basement of the dryer is positioned on a floor or other substrate on which the dryer performs its standard operations (e.g. drying and/or spinning cycles). Such positioning defines a horizontal or at least substantially horizontal plane, which is called the basement plane (X, Y). Planes parallel to the basement plane are therefore substantially horizontal planes.

In this standard operative position, also other terms are well defined: "front" or "rear" (or "back"), "top" or "bottom", "upper" or "lower" are always referred to the normal standard configuration of a dryer with the basement positioned on a floor. The front wall of the dryer is defined by the wall in which the door from which the drum is accessed is positioned. Given the horizontal plane on which the laundry is located, "top" and "bottom"—as their normal common meaning—refer to the position of an object along a vertical axis. In case the basement plane (X,Y)above described is tilted, for example because the dryer is positioned in a non-horizontal floor, the Z axis is tilted as well, however it is still considered the "vertical" axis in a frame of reference where the basement plane represents the horizontality.

In a top view of the dryer, the basement can be considered as "divided" in two longitudinal halves by the axis of rotation of the drum (or the projection of said axis onto the basement plane). Whether the axis is horizontal (where, again horizontal means parallel to the basement plane (X,Y)) or tilted with respect to the latter, on a top view of the basement, the projection of the drum axis divides the basement in two halves, a first or left longitudinal half and a second or right longitudinal half. In other words, taking a plane which is perpendicular to the basement plane and which passes through the rotational axis of the drum, which generally coincides with a line dividing the basement in two, this plane virtually sections the basement in two longitudinal halves. This plane, called first plane, defines a line of division of the basement in two in a top view.

The two halves do not need to be identical. In other words with a first and a second half, a "right" and a "left" portion of the basement with respect of the above mentioned plane first plane) passing through the rotational axis of the drum and perpendicular to the basement plane are meant, regardless of their relative dimensions. Indeed, the projection on the basement of the drum rotational axis can be shifted from the line dividing the basement in two. Preferably, the line dividing the basement in two and the projection on the basement of the rotational axis of the drum coincide.

The basement can be considered to be divided in four "quarters" by the first plane and a second plane perpendicular to it and passing through a center line of the basement parallel to the front (or rear) wall. The centerline is defined as follows. The basement includes a front wall and a back wall. In a top view of the basement, the first plane intersects the front and back wall in two points, called respectively first and second. A middle point still belonging to the first plane and located at an equal distance between the first and second point is defined as well. The centerline is defined as a line perpendicular to the first plane and passing through the middle point. The centerline is substantially parallel to the front and back wall of the basement, although the latter can have an irregular shape. The four quarters could be indicated as the first quarter, the second quarter, the third quarter and the fourth quarter. The first and third quarters are located on one side of the first plane that is, looking at the dryer and facing the loading door, they are located on the "right side" or on the "left side" of the plane), while the second and fourth quarters are located on the opposite side of the first plane that is, looking at the dryer and facing the loading door, on the "left side" or on the "right side", respectively).

Among all possible configurations of the quarters, two are preferred: a first configuration in which the first and second quarters are both located at the front of the basement, for example, both first and second quarters are in contact to the front wall of the dryer, and a second configuration in which the first and second quarters are both at the back of the basement, for example, both first and second quarters are in contact to the rear wall of the dryer. In these first and second configurations then, the remaining third and fourth quarters are either both at the back of the basement or both at the front, respectively. Preferably, the first configuration is preferred when the inlet of air in the basement is located at the rear wall, while the second configuration is preferred when the inlet of air in the basement is located at the front wall.

The basement duct is preferably divided in four by the first and the second plane, e.g. each quarter includes a part of the basement duct. The basement duct extends through the first and second quarters, and through the third and fourth quarters. In a preferred embodiment, the basement duct is symmetric with respect to the first plane, thus in the above mentioned preferred first and second configurations, the basement duct is divided in two by the first plane and thus in the first and second quarters two symmetric parts of the basement duct are present, as well as in the third and fourth quarters. Preferably, the axis of the basement duct is preferably coplanar to the drum axis, therefore the first plane preferably contains the axis of the basement duct. Even more preferably, the main direction of flow of the process air in the basement duct is parallel to the first plane.

A similar configuration of a central straight basement air duct is also known from EP 2549008.

The layout of the basement of the dryer of the invention is the following.

The first heat exchanger and the second heat exchanger are located within the basement air conduit and extend for the majority of their volume within the third and fourth quarters of the basement, e.g. they are substantially located for the majority of their volume either in the front or in the back of the dryer (second or first configuration above described). The heat exchangers can be completely contained within the third and fourth quarters of the basement, or parts of their volume, the minority, can also extend within the first and second quarters of the basement. Also, preferably, the inlet of process air into the basement is located within the third and/or fourth quarters. Preferably, the volumes of the heat exchangers are substantially equally distributed among the third and fourth quarters, that is, both quarters are occupied by the heat exchangers substantially in the same percentage.

On the other end, the compressor and the motor of the drum are located with the majority of their volumes within the first and second quarters of the basement, i.e. on the front or the back of the basement opposite to the position of the heat exchangers. Preferably, in case the basement outlet is realized in the rear part of the basement, i.e. facing the rear wall of the cabinet, the first and second quarters are also located at the back of the basement. More preferably, the motor is positioned with the majority of its volume in one of the first or second quarters and the compressor is positioned with the majority of its volume in the other of the first or second quarters.

In other words, preferably the heat exchangers are positioned at the front or at the back of the dryer and the motor/compressor are conversely positioned at the back or at the front of the dryer. The configuration in which the heat exchangers are at the front and motor/compressor are at the back of the dryer (for the majority of their volumes) is the preferred configuration when the inlet of process air in the basement is positioned at the front wall and the outlet at the rear wall.

In the above outline, as clear, the heat exchangers as well as the motor and the compressor do not hinder each other and they can be "as bulky as possible" with the limitation of the size of the basement. In particular, the heat exchangers can be relatively very long. Differently from the configuration of the basement of EP 2549008 where the basement in divided substantially in three parallel stripes having similar dimensions, positioning the heat exchangers either at the front or at the rear of the dryer and the motor/compressor in the other of the front/rear of the dryer, allows to use heat exchangers as long as possible to maximize the heat exchange with the process air, without being confined by the presence of the motor/engine.

In EP 2549008, the lateral dimension of the heat exchangers is confined by the presence of the motor and the compressor positioned at the sides of the heat exchangers. The only dimension in which the heat exchangers may expand is their thickness, however a thicker heat exchanger (that is, a heat exchangers having more parallel tubes) is not as effective as a "wider" heat exchanger having a larger heat exchanging surface. Indeed, above a given thickness, it is important to have a heat exchanging surface as wide as possible in order to increase the heat exchange efficiency: too high thicknesses increase pressure drops of the process air which meets a high resistance while flowing through the thick heat exchanger. The height of the heat exchangers is always limited by the presence of the drum above the heat exchangers and the fact that the dryer has a substantially fixed standard height. This height of the dryer is in Europe for example fixed at between 80 cm and 85 cm generally.

Several advantages can be achieved with the present solution.

Due to the better aerodynamic layout of the basement duct compared with several ducts of the prior art, the dryer is more efficient, in particular a less turbulent process air flow is obtained. Being the flow more efficient, a smaller minimum heat exchange surface is necessary, because the heat exchange itself is more efficient due to the stability of the air flow. The size of the heat exchangers can be reduced, so that they occupy more or less only the third and fourth quarter of the basement. This in turn means that further volume is available for other functional parts of the dryer. Alternatively, the heat pump can be made even more efficient keeping the same size of heat exchangers or even increasing the same up to the maximum possible width depending on the space available.

In addition, due to the improved air circulation, the energy consumption of the motor(s) for the compressor and the fan is reduced. Further, the noise of the laundry dryer is reduced.

The invention may include in addition or alternatively one or more of the following characteristics.

Preferably, the basement process air formed in said basement includes a first duct wall located within said first quarter of said basement and a second duct wall located within said second quarter of said basement, said first and second duct walls converging to a basement process air outlet. More preferably, in a section along a sectioning plane parallel to said basement plane, said first and second duct walls respectively define a first and second converging curve. Even more preferably, said first and second curve are axially symmetric with respect to a plane passing through a duct axis. Preferably, the duct axis is coplanar to said drum axis.

Preferably, the basement process air duct has a cross section in a plane perpendicular to the basement plane and to the first plane having an area which decreases along the direction of the process air flow. The air duct has preferably a cross section in a plane perpendicular to its axis which becomes smaller and smaller along the direction of air flow. In particular, the widest portion of the basement air duct is where the heat exchangers are located within the duct itself. There, the width of the duct is preferably comprised between 265 mm and 450 mm, more preferably between 320 mm and 370 mm. This duct width is considered when a standard dryer having a standard width of about 600 mm is taken. The width of the dryer is considered as the distance from the two lateral walls of the same (the distance is measured from the outside of a lateral wall to the outside of the opposite lateral wall). Alternatively, the width of the dryer can be defined as the width of the front or of the real wall.

The smallest cross section width of the basement duct is preferably at the outlet of the basement duct, where for example a fan is present. The width of the basement duct at the outlet is preferably comprised between 80 mm and 150 mm.

As said, the above is considered for a dryer of a standard width of 600 mm. In case of a dryers of different width, for example of a width of 700 mm or 500 mm, the relevant parameter is the ratio, i.e. preferably the ratio between the width of the basement and the widest portion of the basement duct is comprised between 1.33 and 2.26, more preferably between 1.62 and 1.875.

Preferably, the width of the heat exchangers is equal to the width of the basement duct. Preferably therefore, the ratio between the width of the basement and the width of the heat exchangers is comprised between 1.33 and 2.26, more preferably between 1.62 and 1.875.

As mentioned, the first and second quarters are occupied by the heat exchangers, which are also positioned inside the basement process air conduit. The absence of side obstacles that may limit the expansion of the heat exchangers laterally (e.g. in the direction parallel to the rear and/or front wall) allows the usage of heat exchangers which are as wide as desired, their maximum width being constrained only by the width of the front and/or rear wall of the dryer.

The basement conduit that contains the heat exchangers is thus in turn at least as wide as the heath exchangers' width, in order to house the same. However, the outlet of the basement conduit portion is preferably not "very big", that is, its dimensions are substantially equal to the dimension of a propeller of a fan used to blow air in the process air circuit. For these reasons, preferably, the width of the basement process air conduit portion is "very large" where the heat exchangers are housed, and then it narrows to the outlet dimension. Thus, the duct walls form converging curves towards the outlet of the basement process air conduit.

Further, preferably the basement process air conduit has a central axis (also called duct axis) which divides the basement process air conduit in two halves. Preferably, the two halves are symmetric with respect to a plane passing through the duct axis and perpendicular to the basement plane. This substantially "straight" duct allows a good flow of the process air.

More preferably, the duct axis of said basement process air circuit portion lies on the first plane.

The first plane therefore divides the basement circuit portion in two halves, preferably symmetric, and thus this implies that the first and the second quarters each contain a "piece" of the basement air conduit, the two pieces being substantially identical. The same applies to the third and fourth quarters, each containing a piece of the basement conduit, the two pieces being symmetric with respect to the first plane.

Preferably, the laundry dryer includes a fan, said fan being located in proximity of a basement process air outlet of said basement downstream said first heat exchanger and said second heat exchanger in the direction of flow of said process air, said fan being apt to rotate around a fan axis, wherein said fan axis is positioned higher than a symmetry axis, parallel to the fan axis, of said first or second heat exchangers.

Preferably, the process air is blown inside the process air conduit by means of a fan. The fan is commonly positioned at an outlet of the basement process air conduit. Preferably, the outlet has a dimension slightly larger than a propeller of the fan. The fan defines a fan axis, which can be considered as the axis of rotation of the propeller. Preferably, this axis of rotation is parallel to the first plane and even more preferably it is contained in the first plane. The heat exchangers also define a symmetry axis, which is an axis through which symmetry planes for the heat exchangers may pass. This symmetry axis is for example defined by the intersection of the diagonals of the heat exchanging surface, which is commonly a rectangle. The symmetry axis is thus the line that joins all the diagonal intersections of the various elements of the heat exchanger (the elements of the heat exchangers are the different adjacent tubing extending in the thickness direction of the heat exchanger).

The fan axis is preferably higher than the symmetry axis of the heat exchanger symmetry axis. In this way, a larger diameter for the fan housing is possible. Larger fan are usable and thus higher process air volume can be moved within the process air conduit. Having the fan axis coincident with the heat exchanger symmetry axis would limit the dimensions of the outlet because there is no much space between the axis location and the bottom of the basement.

Preferably, the fan axis is parallel to said basement plane.

The fan axis is preferably contained in the first plane and it is substantially "horizontal", thus preferably parallel to the basement process air circuit portion.

Preferably, the fan axis lies on the first plane.

The fan is thus "central", for example positioned in the middle of the width of the rear wall. The flow of process air from the inlet, for example located at the front wall, and the outlet, is thus preferably symmetric with respect to the first plane.

Preferably, said basement includes an upper shell portion and a lower shell portion, said basement process air duct being formed by the connection between said upper shell portion and said lower shell portion.

The basement air duct in the basement can be realized for example in an easy and reliable manner joining together the two shell portions so as to form the lateral wall of the duct portion.

Preferably, said basement is realized in plastic material and said basement air duct is formed integrally to said basement.

It should also be observed that, in the present description and in the attached claims, the terms "plastic material" and the like, are used to indicate any plastic or synthetic material, or based on plastic or synthetic material, possibly added with fillers suitable to improve the functional and robustness characteristics thereof, such as minerals, textile synthetic fillers and so on and so forth.

The fact that the basement is realized in plastic allows a minimization of the number of elements included in the dryer of the invention. Indeed, with a single producing process, for example with the same molding process, the basement can be realized including a plurality of additional functional elements for the dryer that do not have to be realized separately and then assembled, such as the basement duct or others for example the seats for the heat exchangers.

Preferably, a first portion of said basement process air conduit within said third and fourth quarters of said basement has a width equal to at least 50% of a width of the basement. More preferably, it has a width equal to at least 60% of a width of the basement. Even more preferably, it has a width equal to at least 70% of a width of the basement. Preferably, the ratio between the width of the basement and the widest portion of the basement duct is comprised between 1.33 and 2.26, more preferably between 1.62 and 1.875.

The first and second heat exchangers are housed—for the majority of their volumes—in that part of the process air conduit which is located in the third and fourth quarters. As mentioned, the width of the heat exchangers is preferably as wide as possible to optimize the dimension of the heat exchanging surface with the process air. A wide heat exchanger thus implies a wide conduit and for this reason preferably the cross section of the basement conduit portion in these quarters where the heat exchangers are contained for the majority of their volumes is at least 50% of the basement width.

As already mentioned, when the width of the heat exchangers is considered, only the width of the heat exchanging surface is taken into consideration. The extra width given by the pipes connection different tubing of the same heat exchanger is not taken into consideration because it is not affecting the heat exchange properties of the heat exchanger.

Preferably, the maximum width of the basement duct which is considered here is the width of the basement duct when taken in a cross section taken along a suitable section plane parallel to the second plane and sectioning the basement duct within the third and fourth quarters.

In the width of the basement, only the part in which heat exchange takes place is considered, where the heat exchangers are located. Therefore, the part of the duct occupied by the "lateral pipes or ducts" in the heat exchangers is not considered in the width calculation.

Preferably, a second portion of said basement process air conduit within said first and second quarters of said basement has a width equal to less than 50% of the width of the basement. More preferably, it has a width equal to less than 40% of the width of the basement. The ratio between the width of the basement and the width of the basement duct in this second part is preferably comprised between 4 and 7.5.

As mentioned, from a very wide first part, the basement conduit portion converges to a smaller size in order to reach the outlet of the basement, which has a size slightly larger than a fan propeller. For this reason, the width of the conduit decreases in size from a size bigger than ½ of the width of the basement to a size smaller than ½ of the width of the basement.

Preferably, the width of the basement duct which is considered here is the width of the basement duct when taken in a cross section perpendicular to an axis of the duct. For example, a suitable section plane is a plane parallel to the second plane. The section plane sections the basement duct within the first and second quarters.

Preferably, said first and second quarters of the basement are in contact to said rear wall.

A preferred configuration is thus the one having the heat exchangers "in front" of the dryer, and the compressor and motor "in the back" of the dryer. Preferably, in this configuration, the inlet of the basement conduit is positioned at the front wall, while the outlet of the basement conduit is located at the rear wall.

Preferably, the motor and the compressor are positioned adjacent to the first and second converging duct walls, respectively.

The basement conduit in the first and second quarters has a cross section which is reduced in comparison to its cross section in the third and fourth quarters, where the heat exchangers are located. This reduction in size, and in particular in diameter, means that there is some "free volume" outside the basement conduit portions between the casing and the conduit walls themselves. In this free volume, the compressor and the motor can be easily located.

Preferably, the drum includes a first and a second end, the second end facing the rear wall of the casing being closed by a back wall.

The drum is therefore preferably a closed drum, with a back wall. Preferably, perforations or apertures are formed in the back wall of the drum so that the process air can pass the drum and dry the clothes located therein.

Preferably, the basement includes a basement process air outlet, the basement process air outlet facing the rear wall.

Preferably, in this configuration, the heat exchangers are in the front part of the dryer. Preferably, the inlet of the basement process air conduit is at the front wall.

Preferably, said casing includes a door and said front wall includes an aperture, said door being hinged on said front wall to open and close said aperture.

More preferably, the inlet of the basement process air conduit is positioned at the aperture. Preferably, at the inlet, a filter is positioned, so that fluff and lint can be removed from the process air before the latter enters in the basement process air conduit. In this way, the heat exchangers are kept substantially fluff and lint free. Eventual fluff and filter that reach the heat exchangers can be blocked by additional filters or removed by an optional cleaning system.

Preferably, the refrigerant in said heat pump circuit includes propane.

Propane is a non-toxic gas and thus it is environmentally friendly. In order to avoid or minimize any risk of explosion, preferably safety elements are located in the basement.

Preferably, a projection on the rear wall of said first heat exchanger and/or of said second heat exchanger and a projection on the rear wall of the compressor at least partially overlap.

Preferably, a projection on the rear wall of said first heat exchanger and/or of said second heat exchanger and a projection on the rear wall of the motor at least partially overlap.

In a front view of the dryer, facing the front wall, the heat exchangers form each a projection on the rear wall. Preferably, this projection has a width which is larger than half of the width of the rear wall. The heat exchangers indeed are, as mentioned, "as wide as possible" to have an optimal heat exchange with the process air. Both heat exchangers are preferably anchored to the bottom of the basement. The compressor and the motor are also preferably anchored to the bottom of the basement and each of them also forms a projection onto the rear wall. The surface defined by the projections of the heat exchangers (preferably the projection of the first heat exchanger and the projection of the second heat exchanger overlap substantially completely) and the surface defined by the projection of the compressor on the rear wall overlap at least in part. Preferably, they overlap completely, that is the heat exchangers' projections "cover" the compressor's projection completely. Preferably, the same applies to the motor projection: the surface defined by the projections of the heat exchangers on the rear wall and the surface defined by the projection of the motor on the rear wall overlap at least in part. Preferably, they overlap completely, that is the heat exchangers' projections "cover" the compressor's projection completely.

BRIEF DESCRIPTION OF THE DRAWINGS

The present invention will now be described with reference to the accompanying drawings that illustrate non-limiting embodiments thereof, wherein.

DETAILED DESCRIPTION OF A PREFERRED EMBODIMENT

Figure 1:
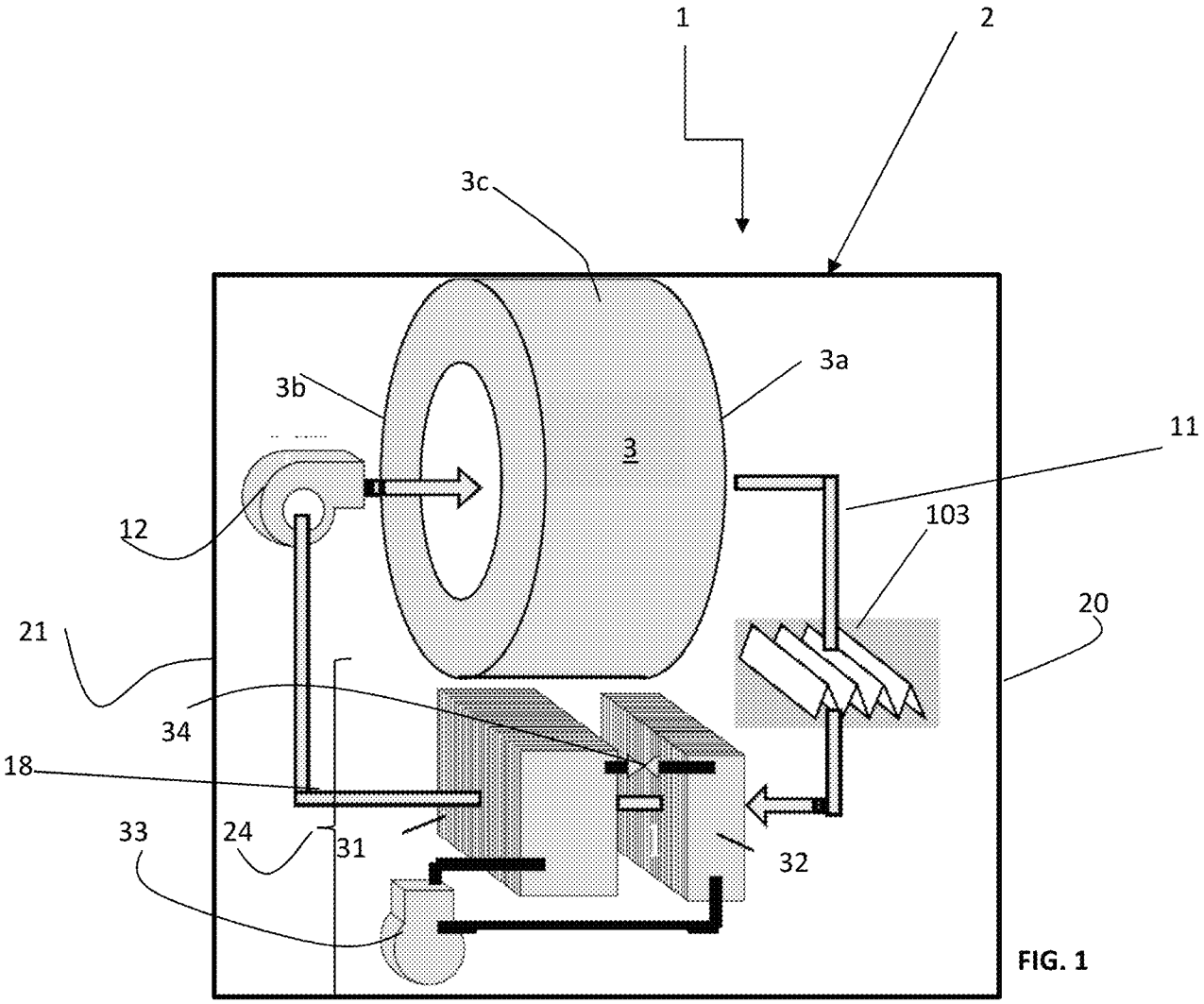
FIG. 1 is a schematic view of a heat pump laundry dryer according to the invention.
Figure 2:
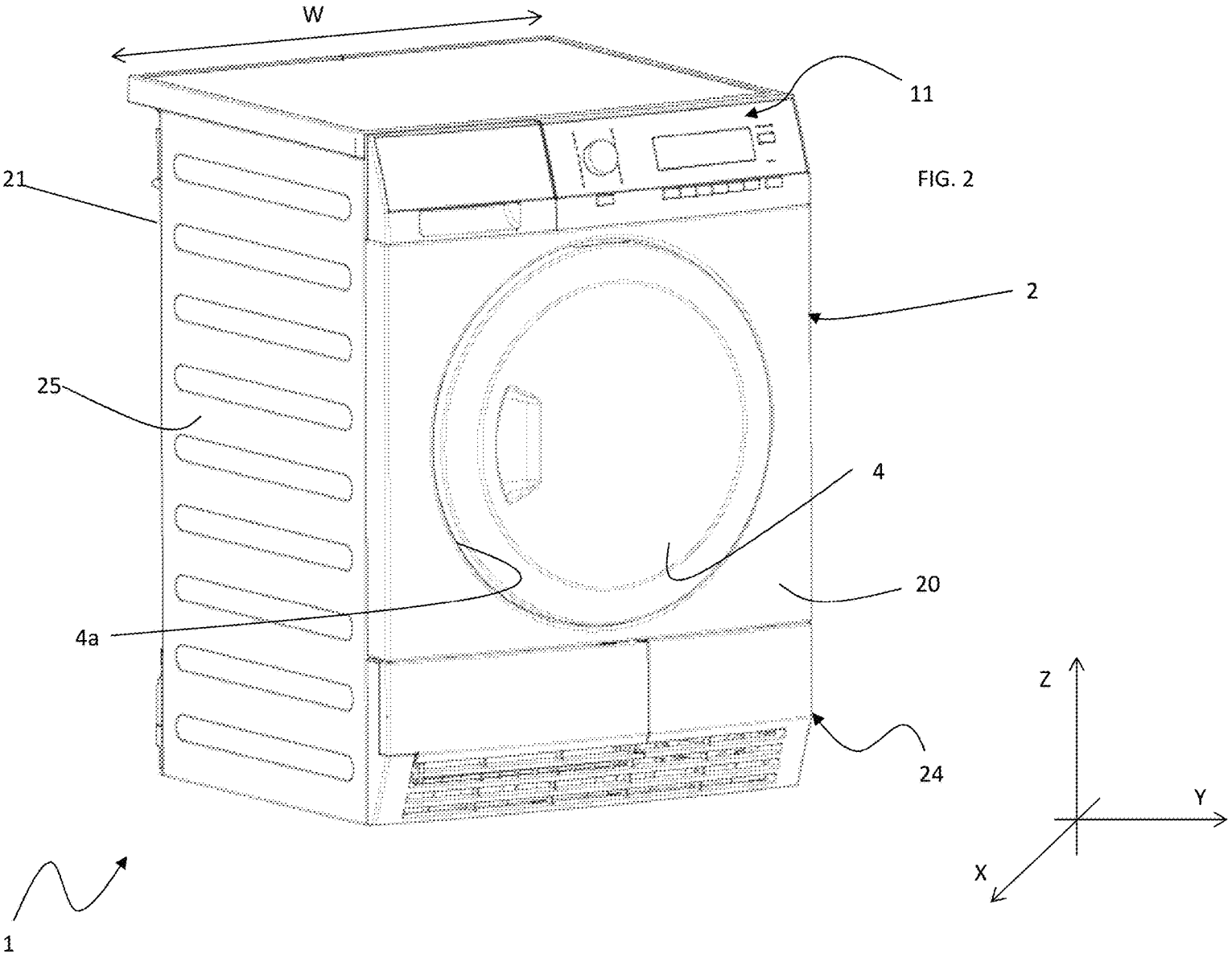
FIG. 2 shows a perspective view of the laundry dryer of FIG. 1.

With initial reference to FIGS. 1 and 2, a laundry dryer realized according to the present invention is globally indicated with 1.

Laundry dryer 1 comprises an outer box or casing 2, preferably but not necessarily parallelepiped-shaped, and a drying chamber, such as a drum 3, for example having the shape of a hollow cylinder, for housing the laundry and in general the clothes and garments to be dried. The drum 3 is preferably rotatably fixed to the casing 2, so that it can rotate around a preferably horizontal axis R (in alternative embodiments, rotation axis may be tilted). Access to the drum 3 is achieved for example via a door 4, preferably hinged to cabinet 2, which can open and close an opening 4*a* realized on the cabinet itself.

More in detail, casing 2 generally includes a front wall 20, a rear wall 21 and two sidewalls 25, all mounted on a basement 24. Preferably, the basement 24 is realized in plastic material. Preferably, basement 24 is molded via an injection molding process. Preferably, on the front wall 20, the door 4 is hinged so as to access the drum. The casing, with its walls, defines the inner volume of the laundry dryer 1. Similarly, the basement defines the basement inner volume delimited by the basement's walls. Advantageously, basement 24 includes an upper and a lower shell portion 24*a*, 24*b* (visible in FIGS. 3 and 5 detailed below). The width of the casing, which is the same as the width of the basement, is indicated with W in the drawing and it is defined either as the width of the front or rear wall (having in this example the same width) or by the distance between the two lateral walls 25.

The dryer 1, and in particular basement 24, defines an horizontal plane (X,Y)which is substantially the plane of the ground on which the dryer 1 is situated, thus it is considered to be substantially horizontal, and a vertical direction Z perpendicular to the plane (X,Y). The plane defined by the basement however can be also tilted from the horizontal one.

Laundry dryer 1 also preferably comprises an electrical motor assembly 50 for rotating, on command, revolving drum 3 along its axis inside cabinet 2. Motor 50 includes a shaft 51, which defines a motor axis of rotation M (see FIGS. 3 and 4).

Further, laundry dryer 1 may include an electronic central control unit (not shown) which controls both the electrical motor assembly 50 and other components of the dryer 1 to perform, on command, one of the user-selectable drying cycles preferably stored in the same central control unit. The programs as well other parameters of the laundry dryer 1, or alarm and warning functions can be set and/or visualized in a control panel 11, preferably realized in a top portion of the dryer 1, such as above door 4.

With reference to FIG. 1, the rotatable drum 3 includes a mantle, having preferably a substantially cylindrical, tubular body 3*c*, which is preferably made of metal material and is arranged inside the cabinet 2 and apt to rotate around the general rotational axis R which can be—as said—horizontal, i.e. parallel to the plane, or tilted with respect to the latter. The mantle 3*c* defines a first end 3*a* and a second end 3*b* and the drum 3 is so arranged that the first end 3*a* of the mantle 3*c* is faced to the laundry loading/unloading opening 4*a* realized on the front wall 20 of the cabinet 2 and the door 4, while the second end 3*b* faces the rear wall 21.

Drum 3 may be an open drum, i.e. both ends 3*a* and 3*b* are opened, or it may include a back wall (not shown in the appended drawings) fixedly connected to the mantle and rotating with the latter.

In order to rotate, support elements for the rotation of the drum are provided as well in the laundry of the invention. Such support elements might include rollers at the front and/or at the back of the drum, as well as or alternatively a shaft connected to the rear end of the drum (shaft is not depicted in the appended drawings). For example, rollers connected to the basement 24 via bosses may be used. Any support element for the rotation of the drum around axis R is encompassed by the present invention.

Dryer 1 additionally includes a process air circuit which comprises the drum 3 and an air process conduit 11, depicted as a plurality of arrows showing the path flow of a process air stream through the dryer 1 (see FIG. 1). In the basement 24, a portion of the air process conduit 11, called basement process air conduit or duct 18, is formed by the connection of the upper shell 24*a* and the lower shell 24*b*. Basement process conduit 18 is preferably connected with its opposite ends to the two opposite sides of drum 3, i.e. first and second rear end 3*a*, 3*b* of mantle 3*c*. Process air circuit also includes a fan or blower 12 (shown in FIG. 1).

A filter 103 may be positioned in the conduit 11 to filter process air coming from the drum 3.

The dryer 1 of the invention additionally comprises a heat pump system 30 including a first heat exchanger (called also condenser) 31 and a second heat exchanger (called also evaporator) 32 (see FIG. 1). Heat pump 30 also includes a refrigerant closed circuit (partly depicted) in which a refrigerant fluid flows, when the dryer 1 is in operation, cools off and may condense in correspondence of the condenser 31, releasing heat, and warms up, in correspondence of the second heat exchanger (evaporator) 32, absorbing heat. A compressor receives refrigerant in a gaseous state from the evaporator 32 and supplies the condenser 31, thereby closing the refrigerant cycle. In the following, the heat exchangers are named either condenser and evaporator or first and second heat exchanger, respectively. More in detail, the heat pump circuit connects via piping 35 (see FIG. 3) the second heat exchanger (evaporator) 32 via a compressor 33 to the condenser 31. The outlet of condenser 31 is connected to the inlet of the evaporator 32 via an expansion device (not visible), such as a choke, a valve or a capillary tube.

Figure 3:
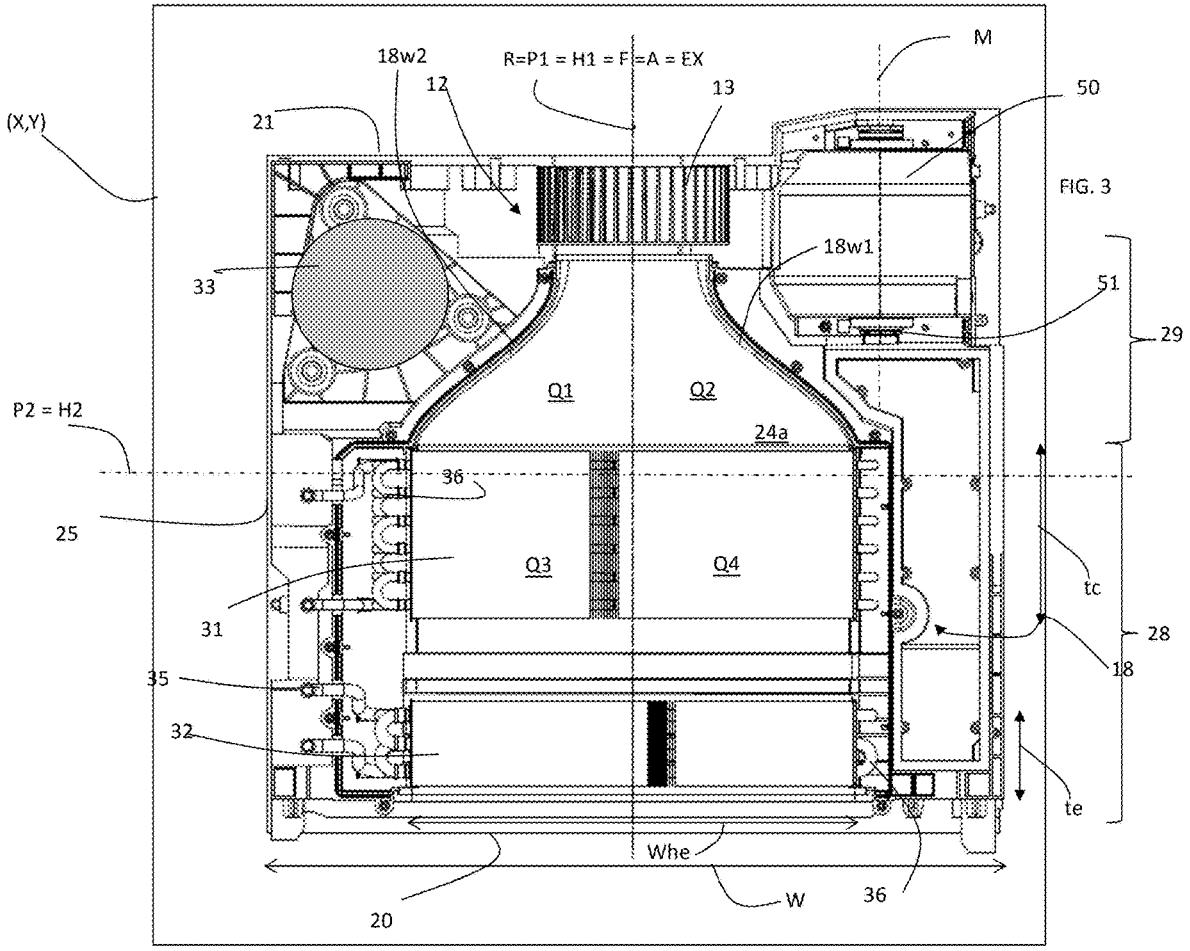
FIG. 3 is a top view, with parts removed, of the basement of the laundry dryer of FIG. 2.

Each heat exchanger 31, 32 includes a plurality of tubes positioned in parallel, forming different layers. The number of layers defines the thickness of the heat exchanger. The thickness of the condenser is indicated with tc and the thickness of the evaporator with te. Preferably, as shown in FIG. 3, tc>te. The tubes are connected via lateral ducts or pipes 36. Each heat exchanger defines a heat exchanger surface, having a width equal to Whe. The width of the heat exchanger 31, 32 is preferably substantially parallel to the front or rear wall 20, 21 of the casing 3. The length Whe does not include the ducts' 36 extension. The height of the heat exchangers is limited by the presence of the drum above them (better detailed below). Preferably, the width of the condenser is substantially identical to the width of the evaporator.

Each heat exchanger defines a heat exchange surface, which is the surface which is hit by the process air. The heat exchange surface has preferably a rectangular shape, given by the width and height of the heat exchangers. The heat exchange surface defines a center, for example the point of intersection of the two diagonals of the rectangle, and each heat exchanger defines therefore a heat exchanger axis EX as the line connecting all the heat exchange surfaces' centers. Preferably, the heat exchanger axis EX of the evaporator coincides with the heat exchanger axis EX of the condenser and therefore in the figure a single axis is visible.

Preferably, in correspondence of evaporator 32, the laundry dryer 1 of the invention may include a condensed-water canister (not visible) which collects the condensed water produced, when the dryer 1 is in operation, inside evaporator 32 by condensation of the surplus moisture in the process air stream arriving from the drum 3. The canister is located at the bottom of the evaporator 32. Preferably, through a connecting pipe and a pump (not shown in the drawings), the collected water is sent in a reservoir located in correspondence of the highest portion of the dryer 1 so as to facilitate a comfortable manual discharge of the water by the user of the dryer 1.

Figure 4:
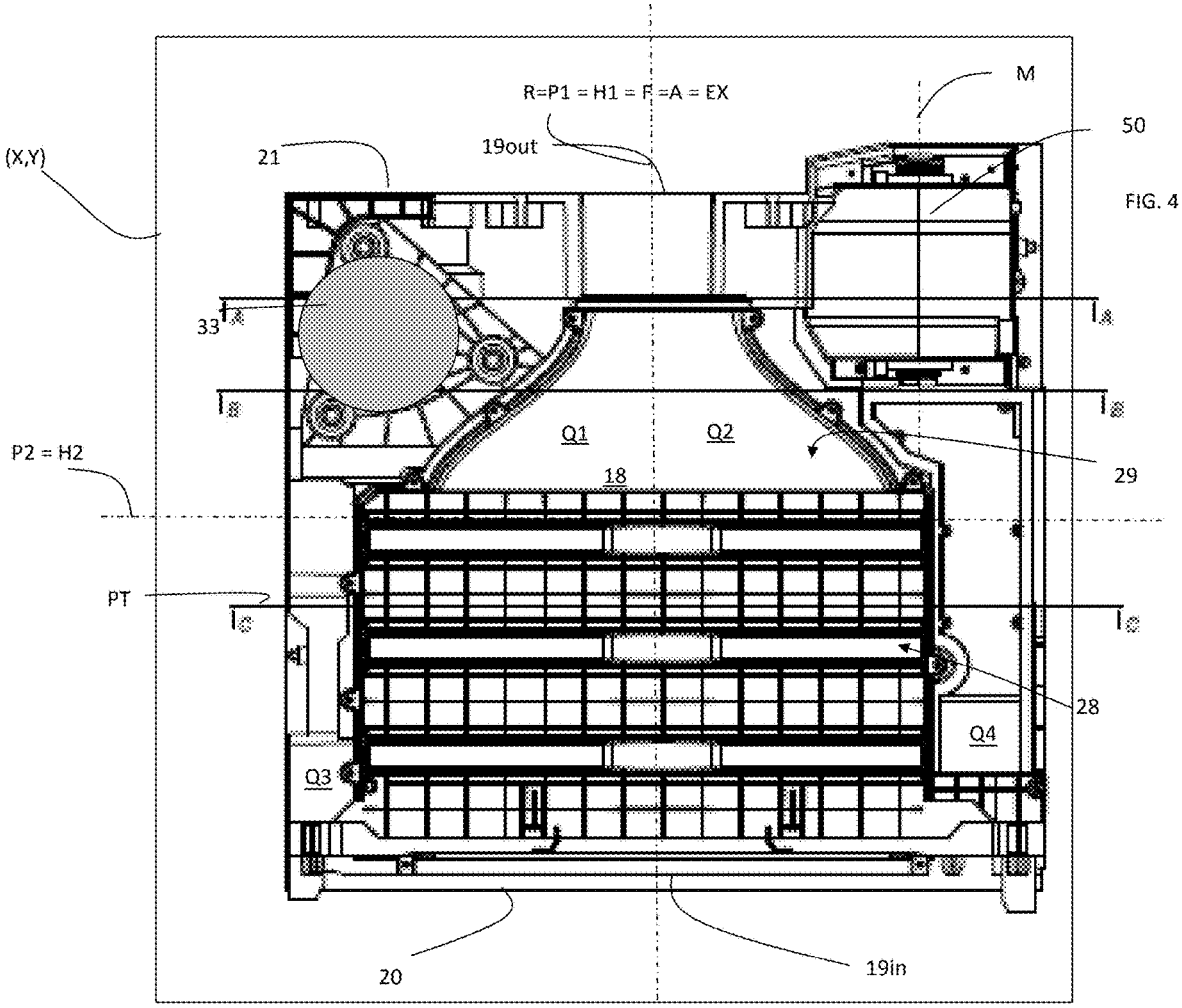
FIG. 4 is an additional top view of the basement of FIG. 3 with the upper portion removed.

The condenser 31 and the evaporator 32 of the heat pump 30 are located in correspondence of the process air conduit 18 formed in the basement 24 (see FIGS. 3 and 4).

In case of a condense-type dryer—as depicted in the appended figures—where the air process circuit is a closed loop circuit, the condenser 31 is located downstream of the evaporator 32. The air exiting the drum 3 enters the conduit 18 and reaches the evaporator 32 which cools down and dehumidifies the process air. The dry cool process air continues to flow through the conduit 18 till it enters the condenser 31, where it is warmed up by the heat pump 30 before re-entering the drum 3.

It is to be understood that in the dryer 1 of the invention, an air heater, such as an electrical heater, can also be present, in addition to the heat pump 30. In this case, heat pump 30 and heater can also work together to speed up the heating process (and thus reducing the drying cycle time). In the latter case, preferably condenser 31 of heat pump 30 is located upstream the heater. Appropriate measures should be provided to avoid the electric heater to fuse plastic components of the dryer 1.

Further, with now reference to FIGS. 3 and 4, in the basement, the process air conduit 18 is formed by the upper and the lower shells 24*a*, 24*b* and includes an inlet 19in from which process air is received from the drum 3 and an outlet 19out to channel process air out of the basement 24. Between inlet 19in and outlet 19out, the conduit or duct 18 is formed, preferably as two single pieces joined together and belonging to the upper and lower shell 24*a*, 24*b*.

Further, duct 18 includes a first and a second portion 28 and 29. The first portion 28 starts from the inlet 19in of the duct 18, and terminates in the second portion 29, which includes the outlet 19out of the duct. In the first portion 28 of the duct 18, the first and the second heat exchangers 31, 32 are located. Preferably, first and second heat exchanger 31, 32 are placed one after the other, the first heat exchanger 31 being downstream in the direction of flow of the process air the second heat exchanger 32.

Further, the second portion 29 channels the process air exiting from the first heat exchanger 31 towards the basement outlet 19out. The second portion 29 thus starts at the location of an exit of the first heat exchanger 31, considered as the location of a plane (X,Y) sectioning the duct portion 29 and substantially in contact with a surface of the first heat exchanger 31 from which process air exits.

Considering now a first plane P1 perpendicular to the basement plane (X,Y) and embedding the rotational axis R of the drum 3, this first plane P1 divides the basement 24 in two halves, called, with now reference to FIGS. 3 and 4, basement first or right half and basement second or left half. These two halves need not to be identical in dimension (i.e. they are not mathematical halves), however in the present depicted embodiment P1 also embeds a first—longitudinal—centerline H1 of the basement. Furthermore, still in the depicted embodiment, P1 is a vertical plane.

Again with reference to FIGS. 3 and 4, considering now a second plane (X,Y)P2, perpendicular to P1 and to the basement plane (X,Y)and passing through a second centerline H2 of the basement, the basement 24 is divided, by a combination of the first and the second plane P1, P2, in four quarters Q1-Q4. The quarters are numbered in a clockwise manner, the first quarter Q1 being the rearmost quarter of the first half of the basement 24 (e.g. the quarter facing the rear wall 21), the second quarter Q2 being the rearmost quarter of the second half of the basement 24, the third quarter Q3 the foremost quarter (e.g. the quarter facing the front wall 20) of the second half of the basement and the last fourth quarter Q4 the foremost quarter of the first half of the basement 24.

It can be therefore seen that the heat exchangers 31, 32 and the first duct portion 28 are substantially contained for the majority of their volume within the third and fourth quarter Q3, Q4, the second heat exchanger closer to the front wall 20 than the first heat exchanger 31; preferably compressor 33 is contained for the majority of its volume within the first quarter Q1, while the motor 50 is located for the majority of its volume in the second quarter Q2. The outlet 19out of basement duct 18 is located between the first Q1 and the second quarter Q2, preferably facing rear wall 21 of casing 2. A small portion of the volume of the first heat exchanger is contained in the first and second quarters.

Motor 50 is preferably contained within the second quarter Q2 and its shaft 51 extends in such a way that it is parallel to plane P1. Preferably, motor shaft 51 is also the shaft of fan 12, which is located in proximity of outlet 19out, preferably facing the latter. Fan 12 blows the process air exiting the basement 24 through outlet 19 into the drum 3, preferably through a passage, not shown, part of the process air circuit 18, formed within the rear wall 21. Preferably, fan 12 includes a propeller 13 which is positioned in the outlet 19out and defines a propeller or fan axis F.

As visible, the heat exchangers 31, 32 are positioned in front of the basement, that is, close to the front wall 20, while the compressor 33 and the motor 50 are positioned in the rear of the basement, i.e. close to the rear wall 21. However, an opposite configuration, where the heat exchangers are positioned at the rear of the basement and the compressor and motor at the front of the basement is feasible as well.

The air process duct 18 is divided in two by the first plane P1. Preferably, the air process duct 18 has an axis A and the first plane P1 is including axis A. Preferably, the first plane P1 is also an axis of symmetry of the duct 18, which is divided in two halves by the first plane P1. Alternatively, the first plane P1 still divides the duct in two parts that are not identical.

On the third and fourth quarters Q3, Q4, the first portion 28 of the duct is positioned, where also the first and the second heat exchanger 31, 32 of heat pump 30 are located. The heat exchangers can be completely contained within the third and fourth quarters or they can also extend beyond the limit defined by the second plane P2, as in the present case. If a portion of the first and/or second heat exchanger 31, 32 is also located within the rear part of the basement 24 (quarters Q1 and Q2), this portion is the minority of the whole volume occupied by the first and/or second heat exchanger 31, 32. The length of the first portion 28 of the duct is therefore at least equal to the distance between the inlet 19in of the duct 18 to the exit of the first heat exchanger 31.

Duct 18 includes walls which form and delimit the duct itself, and the walls form a closed curve, in other words, when the duct 18 is sectioned on a plane perpendicular to the basement plane, the section of the duct walls defines a closed curve. Walls include a first and a second wall 18*w*1 and 18*w*2, considered as lateral wall of the duct. The configuration of walls 18*w*1 and 18*w*2 can change also along the extension of the duct, for example close to the outlet 19out, the section of the duct 18 becomes substantially circular and thus lateral walls 18*w*1 and 18*w*2 become substantially curvilinear or each of them includes an arch of circumference. In the portion of the duct 28 which contains the heat exchangers 31, 32, each wall has substantially a U shape. Any embodiment of the geometrical configuration of walls 18*w*1 and 18*w*2 is encompassed in the present invention.

Preferably, first and second walls 18*w*1 and 18*w*2 are each formed with the upper or lower shell 24*a*, 24*b*. That is to say, the upper shell 24*a* includes part of first wall 18*w*1 and part of second wall 18*w*2, while the lower shell 24*b* includes part of the first wall 18*w*1 and part of second wall 18*w*2.

Considering now a further plane, called sectioning plane PT (several sectioning plane are visible in FIG. 4), a plurality of sections of the basement duct 18 are made as follows. Sectioning plane PT is a plane substantially perpendicular to the basement plane (X,Y), e.g. it is a vertical plane. Preferably, it is also perpendicular to the first plane P1, e.g. it is parallel to P2.

Sectioning plane PT thus sections first wall 18*w*1 and second wall 18*w*2 generating a first curve and a second curve, respectively. The first and second curves are substantially the curves formed by the edges of the first and second walls—respectively—in the location where they have been sectioned.

Figure 5:
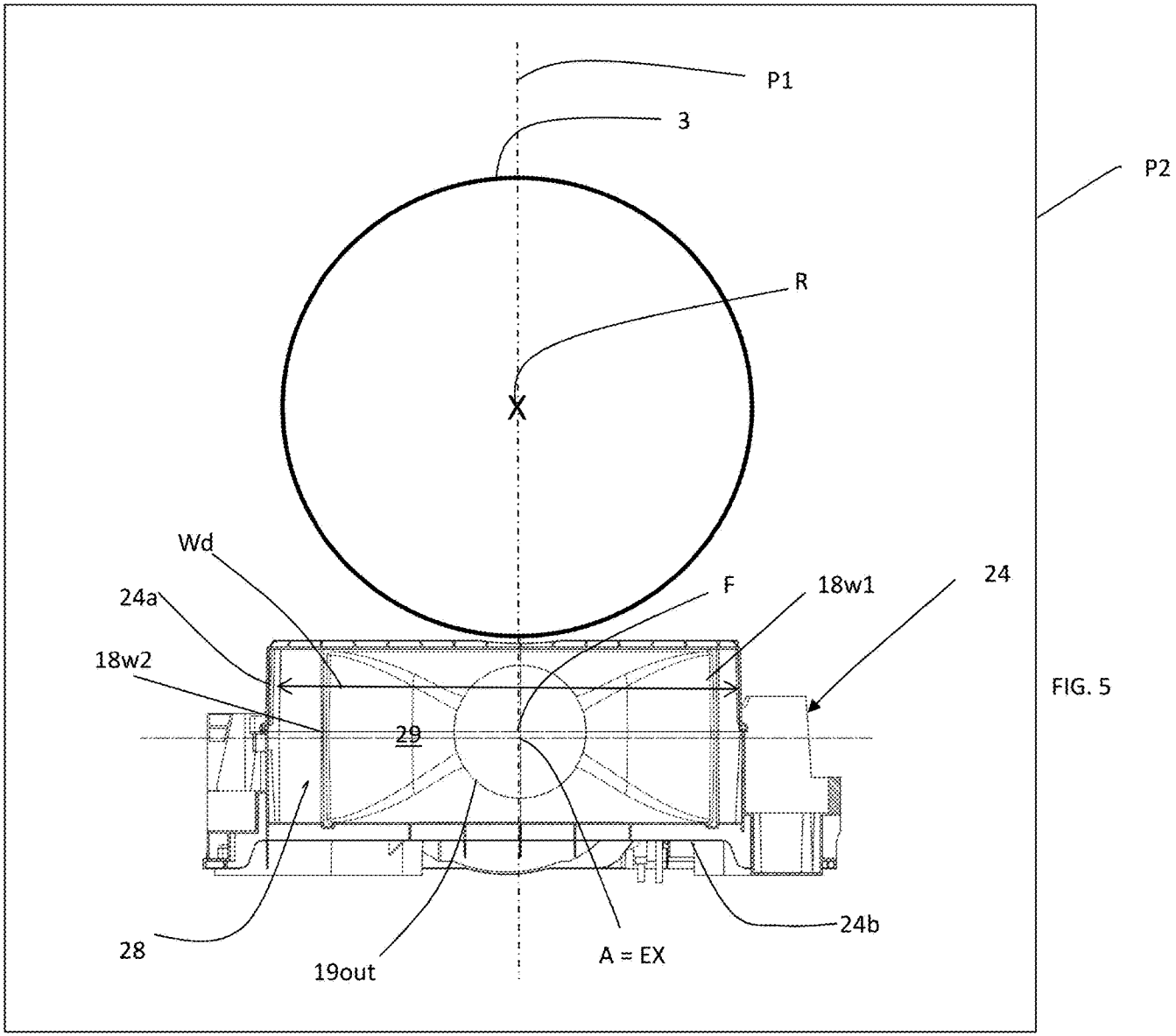
FIG. 5 is a rear sectioned view of a portion of the laundry dryer of FIG. 2 along the C-C line of FIG. 4.

FIG. 5 shows the section of the duct 18 along the plane PT shown in FIG. 4 as sectioning the basement along line C-C. The plane PT in this figure is sectioning the basement parallel to the second plane P2 and in the third and fourth quarters Q3, Q4, corresponding to the first portion 28 of the basement duct 18.

In this portion, the heat exchangers are located. As shown in FIG. 5, the section of the duct 18 is substantially rectangular. This section is section along line C-C as represented in FIG. 4. The section of the duct 18 is also the widest possible section present in the all extension of the duct. The width of the duct Wd is at least as wide as the width Whe of the heat exchangers 31, 32 in order to contain the same. Preferably, the width Whe of the heat exchangers is at least 50% or more of the width W of the basement itself. Therefore, also the width of the basement duct 18 in the first portion 28 is at least 50% or more of the width W of the basement itself. Preferably, the whole first portion 28 of the duct 18 has this "large" width which preferably remains constant along the extension of the first portion of the duct through the third and fourth quarters Q3, Q4. This first portion of the duct starts with the inlet 19in of the basement duct 18 and terminates with the exit of the condenser 31.

The exit of the condenser 31 in this embodiment is positioned in the first quarter Q1 close to the second plane P2. Preferably, a planeincluding the exit of the condenser 31 is parallel to the second plane P2. Further, the exchangers 31, 32 are positioned in the first portion 28 of the duct 18 in such a way that the axis of the heat exchangers EX and the axis A of the duct 18 are parallel and even more preferably they coincide (see FIG. 5).

After the exit of the condenser 31, the second portion 29 of the duct 18 extends. This second portion starts at the exit of the condenser and terminates at the outlet 19out of the duct 18.

Figure 6:
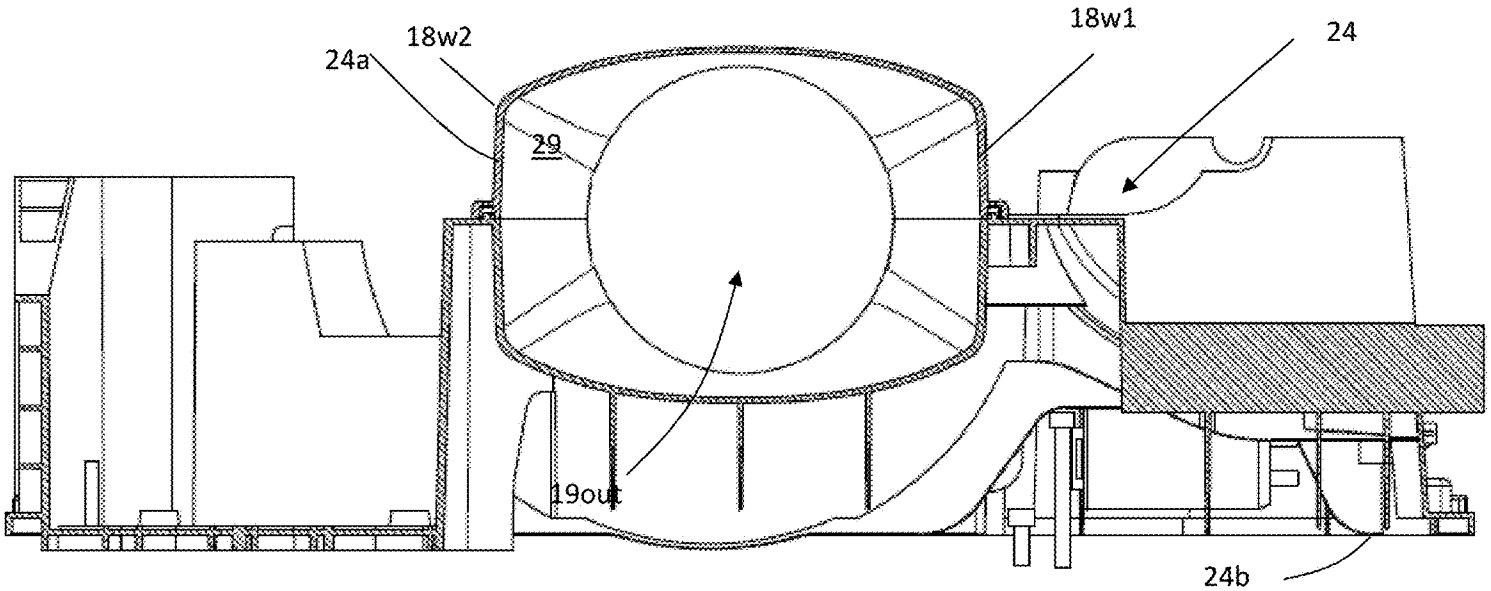
FIG. 6 is a rear sectioned view of a portion of the laundry dryer of FIG. 2 along the B-B line of FIG. 4.
Figure 7:
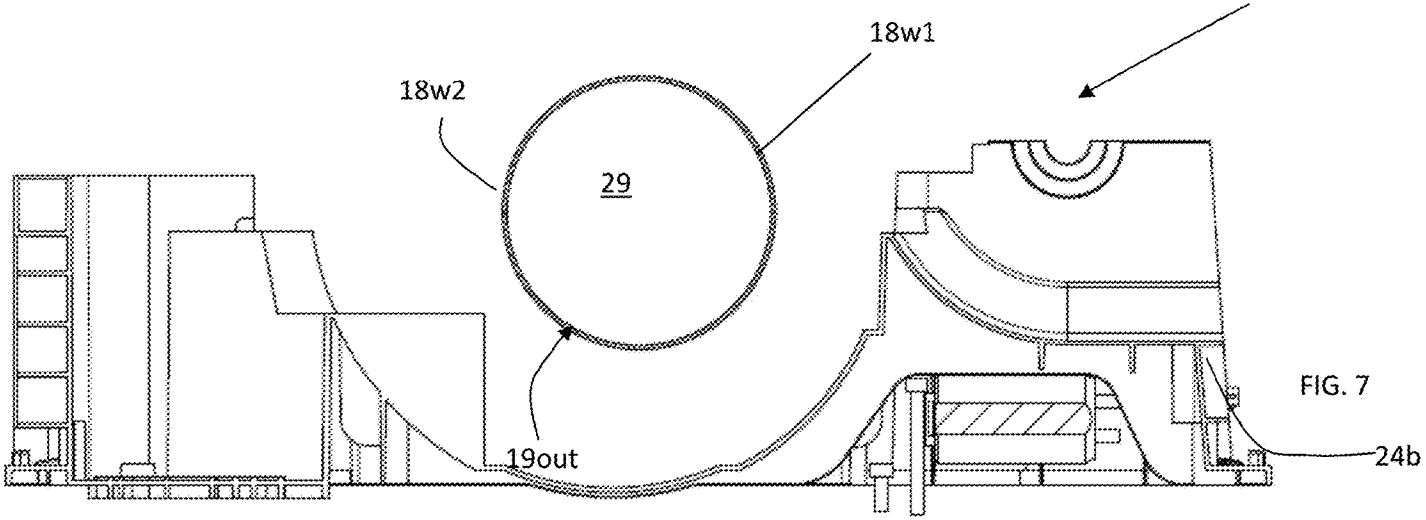
FIG. 7 is a rear sectioned view of a portion of the laundry dryer of FIG. 2 along the A-A line of FIG. 4.

Two sections of the second portion 29 of the duct 18 along section planes PT positioned in the first and second quarters Q1, Q2 and specifically along lines B-B and A-A of FIG. 4 are shown in FIGS. 6 and 7, respectively. In the second portion 29, the walls of the duct 18*w*1 and 18*w*2 are converging, that is, the duct decreases its cross section, and preferably in particular its width, from a maximum which is present at the exit of the first heat exchanger 31, to a minimum present at the outlet 19out.

The size of the outlet, as shown in FIG. 3, is preferably such as to house the propeller 13 of the fan 12. The second portion 29 of the duct is therefore a substantially monotonously converging portion. Preferably, the decrease in the width Wd of the cross section is monotonous from a maximum Whe to a minimum at the outlet 19out.

The convergence can be readily seen comparing the width of the duct in FIG. 5 (width of the first portion 28 of the duct), which is reduced in the section of FIG. 6 and which is at the minimum at the outlet as depicted in FIG. 7. The axis A of the second portion 29 of the duct 18 and the axis EX of the heat exchangers 31, 32 coincide as shown in FIG. 5. Axis A and axis EX are also preferably contained in the first plane P1.

The axis F of the fan 12 is also preferably contained in plane P1, as also depicted in FIG. 5, however it does not coincide with the axes A, EX of the duct 18 and of the heat exchangers 31, 32. Preferably, the axis F of the fan is higher (e.g. above along a vertical axis) than the axes of the duct and of the heat exchangers (see FIG. 5).

Outside duct 18, in the first and second quarters Q1, Q2, at the two sides of the second portion 29 of the duct, where walls 18*w*1 and 18*w*2 are converging, the compressor 33 and the motor 50 are positioned. The converging shape of the duct allows an easy positioning of these elements.

The invention claimed is:

1. A laundry dryer comprising:

a drum configured to contain laundry to be dried, the drum being rotatable about a drum axis (R);

a motor configured to rotate the drum about the drum axis (R);

a casing rotatably supporting the drum and including:

a rear wall and a front wall;

a basement defining a basement plane and in which a first quarter, a second quarter, a third quarter and a fourth quarter are defined by two intersecting first and second planes, the first plane being perpendicular to the basement plane and passing through the drum axis and the second plane being perpendicular to the first plane and passing through a center line of the basement substantially parallel to the rear wall of the casing, the first quarter and the second quarter of the basement being in contact with the rear wall, the first quarter and the third quarter being defined on one side of the first plane and the second quarter and the fourth quarter being defined on an opposite side of the first plane;

a process air conduit in fluid communication with the drum and configured to convey a flow of process air, the process air conduit including a basement process air conduit located in the basement, wherein the basement process air conduit comprises a first duct wall located within the first quarter of the basement and a second duct wall located within the second quarter of the basement, the first duct wall and the second duct wall converging to a basement process air outlet, wherein in a section along a sectioning plane parallel to the basement plane, the first duct wall and the second duct wall respectively define a first converging curve and a second converging curve, and wherein the first and second converging curves extend along a majority of a length of the first and second quarters;

a heat pump having a heat pump circuit configured to convey a flow of a refrigerant, the heat pump circuit including a compressor, a first heat exchanger where the refrigerant is cooled off and the process air is heated up, and a second heat exchanger where the refrigerant is heated up and the process air is cooled off; the first heat exchanger and the second heat exchanger being arranged in the basement process air conduit within the third quarter and the fourth quarter of the basement for a majority of each of their respective volumes in order to perform heat exchange between the refrigerant flowing in the heat pump circuit and the process air; and wherein the motor and the compressor are located, respectively, in the second quarter and the first quarter of the basement for a majority of each of their respective volumes.

2. The laundry dryer according to claim 1, wherein the first converging curve and the second converging curve are axially symmetric with respect to a conduit axis parallel to the drum axis.

3. The laundry dryer according to claim 2, wherein the conduit axis of the basement process air conduit lies on the first plane.

4. The laundry dryer according to claim 1, further comprising a fan located in proximity of a basement process air outlet of the basement downstream of the first heat exchanger and the second heat exchanger in a direction of flow of the process air, the fan being configured to rotate around a fan axis, wherein the fan axis is positioned higher than a symmetry axis, parallel to the fan axis, of the first heat exchanger or the second heat exchanger.

5. The laundry dryer of claim 4, wherein the fan axis is parallel to the basement plane.

6. The laundry dryer according to claim 4, wherein the fan axis lies on the first plane.

7. The laundry dryer according to claim 1, wherein the basement includes an upper shell portion and a lower shell portion connected to the upper shell portion, the basement process air conduit being formed between the upper shell portion and the lower shell portion.

8. The laundry dryer according to claim 1, wherein a second portion of the basement process air conduit within the first quarter and the second quarter of the basement has a width equal to less than 50 percent of a width of the basement.

9. The laundry dryer according to claim 1, wherein the motor and the compressor are positioned adjacent to the second duct wall and the first duct wall, respectively.

10. The laundry dryer according to claim 1, wherein the drum includes a first end and a second end, the second end facing the rear wall of the casing and being closed by a back wall attached to the drum.

11. The laundry dryer according to claim 1, wherein the basement includes a basement process air outlet facing the rear wall.

12. The laundry dryer according to claim 1, wherein the casing includes a door and the front wall includes an aperture, the door being hinged on the front wall and configured to open and close the aperture.

13. The laundry dryer according to claim 1, wherein the refrigerant in the heat pump circuit includes propane.

14. The laundry dryer according to claim 1, wherein a projection on rear wall of the first heat exchanger and/or a projection on a rear wall of the second heat exchanger, and a projection on a rear wall of the compressor or on a rear wall of the motor at least partially overlap.

15. A laundry dryer comprising:

a drum configured to contain laundry to be dried, the drum being rotatable about a drum axis (R);

a motor configured to rotate the drum about the drum axis (R);

a casing rotatably supporting the drum and including:

a rear wall and a front wall;

a basement defining a basement plane and in which a first quarter, a second quarter, a third quarter and a fourth quarter are defined by two intersecting first and second planes, the first plane being perpendicular to the basement plane and passing through the drum axis and the second plane being perpendicular to the first plane and passing through a center line of the basement substantially parallel to the rear wall of the casing, the first quarter and the second quarter of the basement being in contact with the rear wall, the third quarter and the fourth quarter of the basement being in contact with the front wall, the first quarter and the third quarter being positioned on one side of the first plane and the second quarter and the fourth quarter being positioned on an opposite side of the first plane;

a process air conduit in fluid communication with the drum and configured to convey a flow of process air, the process air conduit including a basement process air conduit located in the basement, wherein the basement process air conduit comprises a first duct wall located within the first quarter of the basement and a second duct wall located within the second quarter of the basement, the first duct wall and the second duct wall converging to a basement process air outlet, wherein the first duct wall and the second duct wall respectively define a first converging curve and a second converging curve, and wherein the first and second converging curves extend along a majority of a length of the first and second quarters;

a heat pump having a heat pump circuit configured to convey a flow of a refrigerant, the heat pump circuit including a compressor, a first heat exchanger where the refrigerant is cooled off and the process air is heated up, and a second heat exchanger where the refrigerant is heated up and the process air is cooled off; the first heat exchanger and the second heat exchanger being arranged in the basement process air conduit within the third quarter and the fourth quarter of the basement for a majority of each of their respective volumes in order to perform heat exchange between the refrigerant flowing in the heat pump circuit and the process air; and wherein the motor is positioned adjacent to both the second duct wall and the rear wall in the second quarter and the compressor is positioned adjacent to both the first duct wall and the rear wall in the first quarter.

16. The laundry dryer according to claim 15, wherein a first portion of the basement process air conduit within the third quarter and the fourth quarter of the basement has a width equal to at least 50 percent of a width of the basement.

17. The laundry dryer according to claim 15, further comprising a fan located in proximity of a basement process air outlet of the basement downstream of the first heat exchanger and the second heat exchanger in a direction of flow of the process air, the fan being configured to rotate around a fan axis, wherein the fan axis is positioned higher than a symmetry axis, parallel to the fan axis, of the first heat exchanger or the second heat exchanger.

18. The laundry dryer according to claim 17, wherein the fan axis lies on the first plane.

* * * * *